United States Patent [19]

Bolt et al.

[11] Patent Number: 4,657,753

[45] Date of Patent: Apr. 14, 1987

[54] STABILIZATION OF PITCH FIBER

[75] Inventors: John D. Bolt, Landenberg, Pa.; Mark H. Lukhard, Newark, Del.

[73] Assignee: E. I. Du Pont de Nemours and Company, Wilmington, Del.

[21] Appl. No.: 728,519

[22] Filed: Apr. 29, 1985

[51] Int. Cl.[4] ..... D01F 9/12

[52] U.S. Cl. ..... 423/447.6; 264/29.2; 423/447.4

[58] Field of Search ..... 423/447.4, 447.6, 447.1, 423/447.2; 264/29.2

[56] References Cited

U.S. PATENT DOCUMENTS

| | | | |
|---|---|---|---|
| 3,556,729 | 1/1971 | Holsten et al. | 423/447.6 |
| 3,995,014 | 11/1976 | Lewis | 423/447.4 |
| 4,140,832 | 2/1979 | Menegay | 428/288 |
| 4,301,135 | 11/1981 | Nazem et al. | 423/447.4 |
| 4,534,950 | 8/1985 | Uemura et al. | 423/447.6 |

FOREIGN PATENT DOCUMENTS

| | | | |
|---|---|---|---|
| 1454629 | 11/1976 | United Kingdom | 423/447.4 |

*Primary Examiner*—John Doll
*Assistant Examiner*—Wayne A. Langel

[57] ABSTRACT

Oxidative stabilization of pitch fiber is accelerated in an oxidizing atmosphere wherein the oxidizing gas is at a pressure of at least about two atmospheres.

3 Claims, No Drawings

STABILIZATION OF PITCH FIBER

BACKGROUND OF THE INVENTION

This invention relates to a process for stabilizing (thermosetting) a pitch fiber in preparation for carbonization to carbon fiber.

Pitch fiber is normally melt-spun from mesophase or isotropic pitch or combinations thereof. The melt-spun fiber is then stabilized, also referred to as thermoset, in the presence of an oxidizing gas such as air, oxygen or ozone. It is believed that a certain degree of cross-linking occurs during stabilization which allows the fiber to be subsequently exposed to much higher temperatures without deformation or fusion. Following stabilization, the fiber is generally subjected to elevated temperatures in an inert atmosphere to carbonize the fiber.

The time needed for oxidative stabilization is relatively long. The present invention concerns an improvement in this step which accelerates stabilization.

SUMMARY OF THE INVENTION

This invention deals with an improvement in the process of producing carbon fiber which involves the general steps of melt-spinning pitch fiber, oxidatively stabilizing the fiber and then carbonizing the stabilized fiber.

This improvement comprises accelerating at least part of the oxidative stabilization of the pitch fiber by subjecting the fiber to elevated temperatures in an oxidizing atmosphere at a pressure of at least two atmospheres.

DETAILED DESCRIPTION OF THE INVENTION

This invention deals with an improvement in the process for making carbon fiber from pitch. A conventional method involves melt-spinning a pitch, oxidatively stabilizing the melt-spun fiber and then carbonizing the fiber. The pitch fiber is melt-spun from mesophase pitch, isotropic (non-mesophase) pitch or a combination of mesophase and non-mesophase. The term "pitch" is to be understood as it is used in the art and generally refers to a carbonaceous residue consisting of a complex mixture of primarily aromatic organic compounds which is solid at room temperature and exhibits a relatively broad melting or softening temperature range. The term "mesophase" is to be understood as it is used in the art and is synonymous with liquid crystal.

The melt-spun pitch fiber is then subjected to oxidative stabilization. In this process the pitch is believed to be thermoset or cross-linked to some extent which permits the fiber to be exposed to elevated temperatures in the carbonization step without significant fusion or deformation. Oxidative stabilization is carried out in an oxidizing atmosphere such as air, oxygen, ozone or nitric oxide.

The amount of thermosetting depends in part upon the temperature of the oxidizing gas being supplied, the duration of time the pitch fiber is permitted to thermoset and the nature of the oxidizing gas.

Preferably, the oxidizing gas establishing the gaseous environment has a temperature of at least about 200° C. and no more than about 400° C. The minimum suitable temperature is determined by the lowest temperature at which pitch will react, about 200° C. The maximum temperature to be used is the temperature at which the pitch will flow and cause sticking or deorientation and weakening with resulting breakage, about 300° to 400° C., depending on the particular pitch and on the heat generated by the oxidation reactions. It should be understood that the flow temperature increases as the oxidation reactions proceed and therefore the temperature may be raised as the process proceeds.

Air, oxygen, ozone or nitric oxide is used for the stabilization. The oxidizing gas treatment is carried out under pressure. In accordance with the invention it has been found that oxidation stabilization of the pitch fiber is accelerated if the oxidizing gas is at a pressure of at least two atmospheres during the stabilization step, and preferably at a pressure of at least five atmospheres. In the example which follow, the pitch fibers were placed in an autoclave which was pressurized with air at room temperature. The autoclave was then heated, thus providing the elevated temperature and pressure at which stabilization took place. Stabilization, the point at which the fiber becomes infusible is time, temperature and pressure dependent. The time required for stabilization depends on the pressure and temperature. It is believed that the reaction may be accomplished in as little as one second. At lower temperatures and pressures the maximum time could be as high as several hours. Over-oxidation should be avoided since it may result in pitting of the fiber surface and loss of fiber strength.

It should be understood that other factors such as fiber denier, fiber cross-section, yarn denier, type of pitch, oxygen concentration in the treating atmosphere, and rate of removal of heat of oxidation will also influence the length of time needed for stabilization. Thus, low denier fibers stabilize faster than heavier denier fibers. Stabilization must occur substantially throughout the fiber cross-section and not merely at the surface. Failure to so stabilize may result in melting of the core during subsequent fiber treatment, interfilament sticking, void formation and deorientation. Stabilization may be performed stepwise if desired. Thus stabilization may be partially performed under pressure as described herein and then completed at atmospheric pressure. Some pitches, such as coal tar pitches stabilize more slowly than other pitches, and of course, higher melting pitch fibers can be stabilized at higher temperatures without melting or sticking.

It is preferred to employ air as the oxidizing gas in a batch process because the presence of the inert gases assists in removal of heat of oxidation whereas pure oxygen may be used in a continuous process where gas flow around each filament is relatively unobstructed.

The stabilized fiber is next carbonized in an inert atmosphere in accordance with conventional practice. Nitrogen or argon may be used to provide the inert atmosphere.

The examples which follow illustrate the effect of increased oxidizing gas pressures. In each case samples were placed in small autoclaves and submitted to various time-temperature-pressure conditions. The autoclaves were immersed in a sand bath of controlled temperature. A series of sand bath runs were carried out in which pressure and time were varied at a constant bath temperature of 250°. Fiber density and fusibility were monitored. Fusibility was monitored by heating the fibers in nitrogen to 900° and observing the results. Insufficiently stabilized fibers either completely fused together or had sufficient fiber sticking to give a stiffer, more brittle fiber bundle. As shown by the examples, increased pressure or increased time at a given temperature lead to fibers with higher density, and in general, less tendency to fuse or stick. From these runs, it is evident the pressure accelerates the stabilization reaction.

EXAMPLE 1

Catalytic cracker bottoms (decant oil) was heated at 385° C. for 31.5 hours while sparging with nitrogen at a rate of 0.42 cubic feet per hour per pound of decant oil feed. The resulting pitch was almost totally anisotropic. Using polarized light microscopy the mesophase content was estimated to be 95%. Fibers were prepared from this mesophase pitch by methods known in the art: the pitch was extruded at 324° C. through a single capillary 6 mils in diameter and 12 mils long. Fibers were wound up at a speed of 500 meters per minute. As-spun fibers had a density of 1.3 g/cc and an average diameter of 14.8 microns. A three inch skein of the as-spun fibers was removed from the wind-up bobbin and placed in a cylindrical autoclave 1.1 cm in diameter and 9.3 cm long (inside dimensions). The autoclave was pressurized with air to 100 psig at room temperature and immersed in a sand bath which had been preheated to 265° C. After 7 minutes the autoclave reached 250° C. and the sand bath temperature was controlled so as to keep the autoclave at 250° C. At 250° C. the pressure is calculated to be 187 psig. After a total immersion time of 25 minutes the autoclave was removed and rapidly cooled. The resulting oxidatively stabilized fibers were removed and found to have increased in density of 1.462 g/cc. To test the fibers to determine whether or not they were sufficiently oxidized to withstand further heat treatment in inert atmosphere, the fibers were carbonized to 900° C. in a nitrogen atmosphere. The carbonized fibers were completely fibrous and showed no evidence of fusion or sticking.

EXAMPLES 2–8

Skeins of the as-spun pitch fibers prepared in Example 1 were placed in similar sized autoclaves, pressurized, and immersed in the sand bath described in Example 1. The maximum temperature in the autoclave was 250° C. and was reached in about 7 minutes. Total time in the sand bath and air pressure (where 0 psig represents atmospheric pressure) in the autoclave before immersion were varied and the air pressure at the maximum temperature calculated, all as reported in Table 1. The densities of the resulting fibers increased with increased time and with increased pressure as shown in Table 2. The fibers were carbonized by heating to 900° C. in nitrogen to test for sufficient stabilization. Fibers which are completely fibrous after carbonization are deemed sufficiently stabilized.

TABLE 1

| Example | Pressure (psig, room temp.) | Time in sand bath | Max. Temp. | Pressure (Atm. at Max. Temp.) |
|---|---|---|---|---|
| 2 | 0 | 25 min. | 250° | 1.75 |
| 3 | 33 | " | " | 5.7 |
| 4 | 66 | " | " | 9.6 |
| 5 | 0 | 10 min. | " | 1.75 |
| 6 | 33 | " | " | 5.7 |
| 7 | 66 | " | " | 9.6 |
| 8 | 100 | " | " | 13.7 |

TABLE 2

| Example | Density (g/cc) | Condition after 900° C. Carbonization |
|---|---|---|
| 2 | 1.356 | fused |
| 3 | 1.406 | completely fibrous |
| 4 | 1.410 | completely fibrous |
| 5 | 1.348 | fused |
| 6 | 1.342 | fused |
| 7 | 1.363 | fibers stuck together |
| 8 | 1.366 | completely fibrous |

As can be seen from the above examples the use of pressure decreases the time needed to achieve the oxidative stabilization necessary for the fibers to withstand carbonization.

EXAMPLE 9

This example illustrates the use of oxygen in the stabilization process of this invention. The as-spun mesophase pitch fibers prepared in Example 1 were cut into a skein 3.5 inches long and placed in an autoclave at atmospheric pressure air. Using an electrically heated jacket the temperature was raised to 250° C. over a period of 36 minutes. The autoclave was then pressurized with oxygen to 75 psig and the temperature and pressure were held constant for 20 minutes. After rapid cooling and release of pressure the fibers were removed. The resulting oxidatively stabilized fibers had a density of 1.407 g/cc and were stable to further heat treatment in nitrogen at 900° C., after which the fibers were intact and completely fibrous.

EXAMPLE 10

Mesophase pitch was prepared by a process similar to that disclosed in Greenwood patent, U.S. Pat. No. 4,277,324. The mesophase pitch was essentially 100% anisotropic as determined by polarized reflected light microscopy. Five hundred filament yarn was obtained by melt spinning. Four ten inch long skeins of yarn were placed in a stainless steel cylindrical autoclave measuring approximately 29 cm long and 1.1 cm in diameter. The autoclave was pressurized to 200 psig with air at room temperature and sealed. The autoclave was immersed in a sand bath. The temperature of the bath was raised over a period of 33 minutes to 225° C. (The pressure was estimated to be 344 psig at 225° C.) The sample was held at this temperature for 80 minutes, after which the autoclave was removed from the sand bath, cooled rapidly, and the pressure released. The oxidatively stabilized fibers which resulted had a density of 1.433 g/cc and were infusible upon further heat treatment. Seven inch portions of the oxidatively stabilized yarn were carbonized at a temperature of 1936° C. These carbonized fibers had a tenacity of 13.0 grams per denier (averge of 10 filaments, one inch gage length), a modulus of 2000 grams per denier, an average denier per filament of 1.21, and a density of 2.16 g/cc.

EXAMPLE 11

An optically isotropic pitch was prepared by heating the 900° F. plus fraction of a pyrolysis tar at 725° F. for 6 hours while sparging the pitch with nitrogen at 4 standard cubic feet per hour per pound of starting pitch. The resulting pitch was completely isotropic as determined by reflected light microscopy of its polished surface. The pitch had a carbon to hydrogen ration of 1.57. This isotropic pitch was melt spun into fibers by extrusion at 321° C. through a 9 mil capillary. The fibers were would onto a bobbin at 525 meters per minute. The resulting fibers had a diameter of 17 microns and a density of 1.245 g/cc. A three inch skein of the above fibers was removed from the wind-up bobbin and placed in an autoclave tube. The tube was heated to 250° C. over a period of 35 minutes as described in Example 9. The internal pressure was then raised to 165 psig by the addition of air, and the temperature and pressure were held constant for a period of 20 minutes. The pressure and temperature were rapidly lowered. The resulting oxidatively stabilized fibers had a density of 1.324 g/cc. The resulting fibers were completely infusible to further heating as determined by heating them to 900° C. in a nitrogen atmosphere.

We claim:

1. In a process of producing a carbon fiber from pitch wherein pitch is melt-spun through a spinneret to form pitch fiber, the fiber is stabilized in an oxidizing atmosphere at elevated temperature and then the stabilized fiber is carbonized to produce the carbon fiber, the improvement comprising performing at least part of the stabilization in air or oxygen at a pressure of at least two atmospheres whereby the time necessary to achieve stabilization is reduced.

2. The process of claim 1 wherein the oxidizing atmosphere is at a pressure of at least five atmospheres.

3. The process of claim 1 wherein the stabilization is carried out at a temperature of at least 200° C.

* * * * *